US007114219B2

(12) United States Patent
Kiefer et al.

(10) Patent No.: US 7,114,219 B2
(45) Date of Patent: Oct. 3, 2006

(54) AUTOMOBILE HINGES

(75) Inventors: James Kiefer, Grand Rapids, MI (US); Robert N Alt, Jr., Grand Rapids, MI (US)

(73) Assignee: Ran Enterprises, Inc., Grand Rapids, MI (US)

( * ) Notice: Subject to any disclaimer, the term of this patent is extended or adjusted under 35 U.S.C. 154(b) by 84 days.

(21) Appl. No.: 10/650,628

(22) Filed: Aug. 28, 2003

(65) Prior Publication Data

US 2004/0055112 A1 Mar. 25, 2004

Related U.S. Application Data

(60) Provisional application No. 60/406,847, filed on Aug. 29, 2002.

(51) Int. Cl.
*E05D 3/06* (2006.01)

(52) U.S. Cl. ..... 16/366; 16/371; 16/374; 16/375

(58) Field of Classification Search ..... 16/366, 16/368, 371, 370, 374–376, 235, 236, 239, 16/247, 254, 260, 270, 250
See application file for complete search history.

(56) References Cited

U.S. PATENT DOCUMENTS

| | | | | |
|---|---|---|---|---|
| 388,409 | A | 8/1888 | Grau | 16/364 |
| 523,304 | A | 7/1894 | Collins | 16/364 |
| 546,909 | A | 9/1895 | Spencer | 16/270 |
| 617,043 | A | 1/1899 | Phifer | 16/271 |
| 650,492 | A | 5/1900 | Shoemaker | 16/270 |
| 888,049 | A | 5/1908 | Squires et al. | 16/252 |
| 891,275 | A | 6/1908 | Marr | 16/364 |
| 1,092,236 | A | 4/1914 | Wrikeman | 16/271 |
| 1,186,637 | A | 6/1916 | Williams | 16/272 |
| 1,228,481 | A | 6/1917 | Saino | 16/237 |
| 1,360,284 | A | 11/1920 | Gagnon | 16/249 |
| 1,469,525 | A | 10/1923 | Nadolney | 16/271 |
| 1,481,142 | A | 1/1924 | Minton et al. | 16/271 |
| 1,569,619 | A | 1/1926 | Cranzler | 16/376 |
| 2,027,888 | A | 1/1936 | Solomon | 16/249 |
| 2,211,581 | A | 8/1940 | Ross | 16/179 |
| 3,191,217 | A | 6/1965 | Squire | 16/145 |

(Continued)

OTHER PUBLICATIONS

Exhibit A. Drawings of a hinge that was on sale more than one year prior to the filing date of the present application. Dated Oct. 2000.

(Continued)

*Primary Examiner*—Robert J. Sandy
*Assistant Examiner*—Michael J. Kyle
(74) *Attorney, Agent, or Firm*—Van Dyke, Gardner, Linn & Burkhart, LLP

(57) ABSTRACT

A hinge for pivotably mounting a panel to a vehicle body includes a panel attachment plate securable to the panel, a body attachment plate securable to the vehicle body, and an intermediate member pivotably attached between the body and panel attachment plates. The intermediate member has opposite sidewalls and a center flange extending between the sidewalls. The sidewalls engage the body attachment plate with the center flange spaced from the body attachment plate when the intermediate member is pivoted such that the sidewalls are positioned generally along the body attachment plate. The intermediate member may include a stop member for limiting pivotal movement of the panel attachment plate. The stop member may limit such pivotal movement at different positions by being cut to different sizes during manufacture of the hinge. The body attachment plate may provide a hinge portion that provides enhanced structural rigidity to the hinge.

34 Claims, 12 Drawing Sheets

U.S. PATENT DOCUMENTS

| | | | | | |
|---|---|---|---|---|---|
| 3,965,532 | A | | 6/1976 | Wigfall | 16/149 |
| 4,305,614 | A | | 12/1981 | Holka et al. | 296/37.16 |
| 4,400,848 | A | * | 8/1983 | Grass | 16/332 |
| 4,407,044 | A | | 10/1983 | Iseki | 16/237 |
| 4,532,675 | A | | 8/1985 | Salazar | 16/335 |
| 4,780,929 | A | * | 11/1988 | Burns et al. | 16/349 |
| 4,794,669 | A | * | 1/1989 | Sanders | 16/341 |
| 4,807,331 | A | | 2/1989 | Calucci | 16/262 |
| 4,864,687 | A | * | 9/1989 | Calcaterra et al. | 16/237 |
| 5,038,436 | A | | 8/1991 | Ihrke | 16/249 |
| 5,062,181 | A | * | 11/1991 | Bobrowski et al. | 16/354 |
| 5,067,201 | A | | 11/1991 | Marchione | 16/270 |
| 5,095,582 | A | | 3/1992 | Ohlsson | 16/235 |
| 5,297,314 | A | | 3/1994 | Bender et al. | 16/270 |
| 5,361,455 | A | | 11/1994 | Kiefer | 16/235 |
| 5,398,379 | A | | 3/1995 | Kiefer | 16/364 |
| 5,557,827 | A | * | 9/1996 | Lautenschlager et al. | 16/237 |
| 5,611,114 | A | * | 3/1997 | Wood et al. | 16/366 |
| 5,779,299 | A | * | 7/1998 | Purcell et al. | 296/121 |
| 5,937,480 | A | | 8/1999 | Kiefer | 16/260 |
| 6,591,452 | B1 | * | 7/2003 | Jacquin | 16/332 |

OTHER PUBLICATIONS

Exhibit B. Drawings of the center section of the hinge of Exhibit A. Dated Feb. 1997.

* cited by examiner

AUTOMOBILE HINGES

CROSS REFERENCE TO RELATED APPLICATION

The present application claims priority of U.S. provisional application, Ser. No. 60/406,847, filed Aug. 29, 2002 by Kiefer for AUTOMOBILE HINGES, which is hereby incorporated herein by reference in its entirety.

FIELD OF THE INVENTION

The present invention relates to hinges, and more particularly to hinges used on vehicles, such as automobiles, such as vans, min-vans, sport utility vehicles, cars, sedans, hatchbacks, coupes and the like.

BACKGROUND OF THE INVENTION

Modern automobiles include a number of different types of hinges. Some hinges are used to mount the doors to the body of the vehicle, others to mount the trunk lid or deck lid to the vehicle body, others to pivotably support the rear door or gate of a vehicle at the rear of the vehicle body (such as, for example, the body of a minivan or sport utility vehicle or the like), and others are used to mount the hood to the vehicle body. In many cases, different models of vehicles require different hinges because of the different constructions of the different vehicle models. One of these differences relates to the stopping position of the hinge. For example, the hinges used to support the rear gate of a vehicle often include stops built into the hinge to stop the rear gate from pivoting upwardly past a certain point. While the vehicle will often include gas struts on the upwardly pivoting rear gate that stop the rear door from pivoting beyond a given angle of opening, it is typically the case that the gate hinge includes upward stops that limit or positively stop the extent to which the gate can be lifted before the gas struts are mounted to the gate and vehicle. The stops may thus prevent the gate or door from rolling over onto the top of the vehicle during initial assembly of the vehicle in the vehicle assembly plant. The gate is typically installed on the vehicle body in the "body in white" area of the vehicle assembly plant before the vehicle body and doors and other components are moved to the paint area. After the vehicle is painted, the gate is raised and the gas struts are installed. The gas struts then provide the stops for the gate to limit the upward pivotal movement of the gate.

The stops on the hinges thus may control the degree of opening, depending on where they are located, and may prevent the gate from rolling over onto the top of the vehicle body. For different models of vehicles, the angular position of the respective hinge when it has reached its upward limit will desirably be different, due to different rear door constructions and different overall vehicle constructions and different desired opening angles.

Typically, in order to accommodate the different stop positions for the hinge, it has often been necessary to construct different hinges, with each particular hinge being used with a specific vehicle model. The construction of different hinges for each vehicle, however, is typically relatively expensive. Automobile manufacturers are increasingly looking to use common parts on different vehicle models in order to reduce the costs associated with manufacturing so many separate parts. The desirability of an automobile hinge that can easily accommodate different stopping positions can therefore be seen.

Automobile manufactures are also looking to decrease the manufacturing costs of virtually all automobile components, including vehicle hinges. Some automobile hinges have included relatively expensive components, such as extruded aluminum parts that are cut and further processed after the extrusion process takes place. The aluminum parts typically require strengthening ribs or flanges or the like formed thereon to make the parts strong enough to withstand the forces typically encountered during opening and closing of the pivotable components. The use of aluminum is often desirably avoided due to its relatively expensive nature as compared with other metals. Other hinge parts have been made out of bent tubular steel in order to provide suitable strength. Bent tubular steel, however, is also typically relatively expensive as compared to other manufacturing materials and techniques.

The desire thus exists for automobile hinges that have reduced manufacturing costs as compared to present hinges and techniques. Furthermore, it is desirable to reduce the weight of automobile hinges while still retaining the necessary structural strength. Therefore, there is a need in the art for an automobile hinge that overcomes the shortcomings of the prior art.

SUMMARY OF THE INVENTION

The present invention provides several hinge types that are easier and less expensive to manufacture than conventional hinges. In one embodiment of the present invention, a hinge construction is provided that can accommodate different stopping positions. The basic hinge construction may thus be used or implemented in different vehicle models that require different stopping positions, thereby reducing manufacturing and tooling costs of the hinges. The hinge includes an intermediate member that may be stamped from a single piece of metal, such as steel or the like, and which may be lighter and less expensive to manufacture than comparable parts, such as aluminum extruded components or bent tubular steel or the like. The intermediate member is formed in a manner that enhances the strength of the intermediate member to limit or substantially preclude bending or twisting of the intermediate member under loads typically encountered during opening and closing of the pivotable door, gate or panel or the like. The body attachment plate of the hinge may be formed to substantially enhance the structural rigidity of the plate to resist or limit or substantially preclude flexing or bending or twisting of the plate during use of the hinge.

According to an aspect of the present invention, an automobile hinge for pivotally mounting a pivotable component or panel to a vehicle body includes a panel attachment plate adapted to be secured to the pivotable panel of the vehicle, a body attachment plate adapted to be secured to the vehicle body, and an intermediate member pivotably attached to the body attachment plate and the panel attachment plate. The intermediate member comprises opposite sidewalls and a center flange extending between the sidewalls. The sidewalls engage the body attachment plate with the center flange being spaced from the body attachment plate when the intermediate member is pivoted toward a first position where a first portion of the intermediate member is positioned generally along the body attachment plate. The center flange may include a fastener portion extending toward the body attachment plate when the intermediate member is positioned or pivoted toward the first position. The intermediate member may be fixedly securable to the body attachment plate via a fastener at least partially through the body attachment plate and the fastener receiving portion.

The intermediate member may comprise first and second portions that are arranged at an angle relative to one another. The intermediate member may be pivotably attached to the body attachment plate at a junction of the first and second portions. The panel attachment plate may be pivotably attached to the intermediate member at an end of the second portion opposite the junction of the first and second portions.

The intermediate member may include a panel stop member configured to engage a portion of the panel attachment plate to limit pivotal movement of the panel attachment plate relative to the intermediate member. The stop member may be adaptable to limit pivotal movement of the panel attachment plate at different positions by being cut or formed to different sizes during the manufacturing of the automobile hinge.

The intermediate member may include a body plate stop member that is configured to engage a portion of the body attachment plate to limit pivotal movement of the intermediate member away from the first position. The body plate stop member may comprise at least one flange protruding from the first portion of the intermediate member and configured to engage a corresponding flange extending from the body attachment plate.

According to another aspect of the present invention, an automobile hinge for pivotably mounting a pivotable component or panel to a vehicle body comprises a panel attachment plate adapted to be secured to a pivotable panel or component of a vehicle, a body attachment plate adapted to be secured to a vehicle body, and an intermediate member pivotably attached to the body attachment plate and the panel attachment plate. The intermediate member includes at least one stop that is adapted to limit the range of pivotal movement of the panel attachment plate relative to the intermediate member. The at least one stop limits pivotal movement of the panel attachment plate at different positions by being cut or adjusted or formed to different sizes during manufacturing of the automobile hinge.

The intermediate member may be stamped out of a metallic material. The intermediate member may include opposite sidewalls and a center flange extending between the sidewalls. The panel stop member or members may comprise a pair of panel stop members extending from respective ones of the sidewalls at an end of the intermediate member. The panel attachment plate may be pivotably mounted generally at the end of the intermediate member and generally adjacent to the stop members, such that the stop members engage the panel attachment plate to limit pivotal movement of the panel attachment plate in one direction.

According to another aspect of the present invention, a method for making an automobile hinge comprises providing a panel attachment plate adapted to be secured to a pivotable panel component vehicle, providing a body attachment plate adapted to be secured to a body of a vehicle, and providing an intermediate member that has a stop portion formed thereon. The intermediate member is pivotably attached to the body attachment plate and the panel attachment plate is pivotably attached to the intermediate member. The stop portion of the intermediate member is trimmed or adjusted to define a stop, which is configured to limit the range of pivotal movement of the panel attachment plate relative to the intermediate member. The degree of the trimming process adapts the stop to define the stopping position of the panel attachment plate relative to the intermediate member. A greater portion may be trimmed from the intermediate member to create a greater range of pivotal motion of the panel attachment plate relative to the intermediate member. Optionally, a lesser portion may be trimmed from the intermediate member to create a lesser range of pivotal motion of the panel attachment plate relative to the intermediate member.

According to another aspect of the present invention, an automobile hinge for pivotably mounting a pivotable panel component to a vehicle body comprises a panel attachment plate adapted to be secured to a pivotable panel of a vehicle, an intermediate member and a body attachment plate. The intermediate member comprises first and second leg portions angularly disposed relative to one another. The panel attachment plate is pivotably attached at or near an end of the first leg portion of the intermediate member opposite a junction of the first and second leg portions. The body attachment plate includes a plate portion adapted to be secured to a vehicle body and at least one generally vertical raised flange or wall. The flange includes a first flange portion extending at least partially along an edge or edge portion of the plate portion (such as along a rear portion of the plate) and a second flange portion extending at an angle to the first flange portion to define a hinge portion of the body attachment plate. The at least one raised flange provides structural support to the plate portion. The intermediate member is pivotably attached to the body attachment plate at the hinge portion via a pivot member extending through the second flange portion of the at least one raised flange portion and through the intermediate member.

The second flange portion may comprise spaced apart and opposed flange portions that cooperatively define the hinge portion. The at least one raised flange may comprise two flanges along opposite portions of the edge portion of the plate portion. Each of the flanges may extend at an angle to or generally transverse to the edge portion and may comprise a respective one of the spaced apart and opposed second flange portions to cooperatively define the hinge portion. The second leg portion of the intermediate member may include at least one stop extending therefrom for engaging a raised projection extending from the at least one raised flange to limit pivotal movement of the intermediate member about the pivot member.

In another embodiment of the present invention, a hinge component is provided that is adapted to be attached to a pivotable portion or panel of a vehicle, such as an automobile hood or deck lid or the like. The hinge component is made from a single piece of metal that is stamped into a U-shaped channel and includes one end adapted to be attached to the hood or pivotable panel, and another end adapted to be pivotably attached to the vehicle body. The end adapted to be attached to the vehicle body includes a thickened region which can be net pierced for accommodating a pivot pin or axis. The construction of the hinge component may be less costly than comparable components, such as those made from metal tubing or the like.

According to another aspect of the present invention, a hinge component for pivotably mounting a pivotable component or panel to a vehicle body comprises a first wall, a second wall and a third wall constructed from a single piece of material and joined together to form a generally U-shaped elongated member. Each of the walls defines one of the sidewalls and bottom walls of the U-shaped member. The elongated U-shaped member includes a least one bend along its length and has first and second ends. The first end is adapted to be secured to a pivotable automobile component or panel, such as a hood, deck lid or the like. The second end is adapted to be pivotably attached to a pivot pin at the vehicle body. The second end is defined by the sidewalls of the U-shape being compressed together. At least one of the sidewalls includes an extension that is folded onto the compressed sidewalls to form a planar wall region having at least three layers of walls in planar contact with one another. The hole may be created by net piercing during the manufacturing and assembly of the vehicle. The pivotable component may be aligned with the vehicle body prior to creating the hole in the hinge component, whereby the hole may be created in a manner that ensures that the pivotable component is properly aligned with the vehicle body when the hinge component is attached to the vehicle body.

Therefore, the present invention provides a hinge or hinge component for a vehicle or automobile that may limit pivotal movement of a pivotable panel or component at a desired location. The intermediate member of the hinge provides enhanced structural rigidity, while providing common hinge parts for multiple vehicles or vehicle lines. The stop portions of the intermediate member may be selectively trimmed to trim the stop portions to set a desired stop location for positively stopping the pivotal movement of the pivotable component relative to the intermediate member and the vehicle body. The present invention also provides for enhanced structural rigidity of the body attachment plate via a raised rib or flange extending along the rear portion of the body attachment plate that also extends rearward to define the hinge portion of the body attachment plate. The present invention also provides for a hinge component that provides an increased wall thickness at a mounting end of the hinge component to enhance the structural rigidity of the hinge component, while manufacturing the hinge component out of a single stamped piece of metal.

These and other objects, advantages, purposes and features of the present invention will become apparent upon review of the following specification in conjunction with the drawings.

DESCRIPTION OF THE PREFERRED EMBODIMENTS

Figure 1:
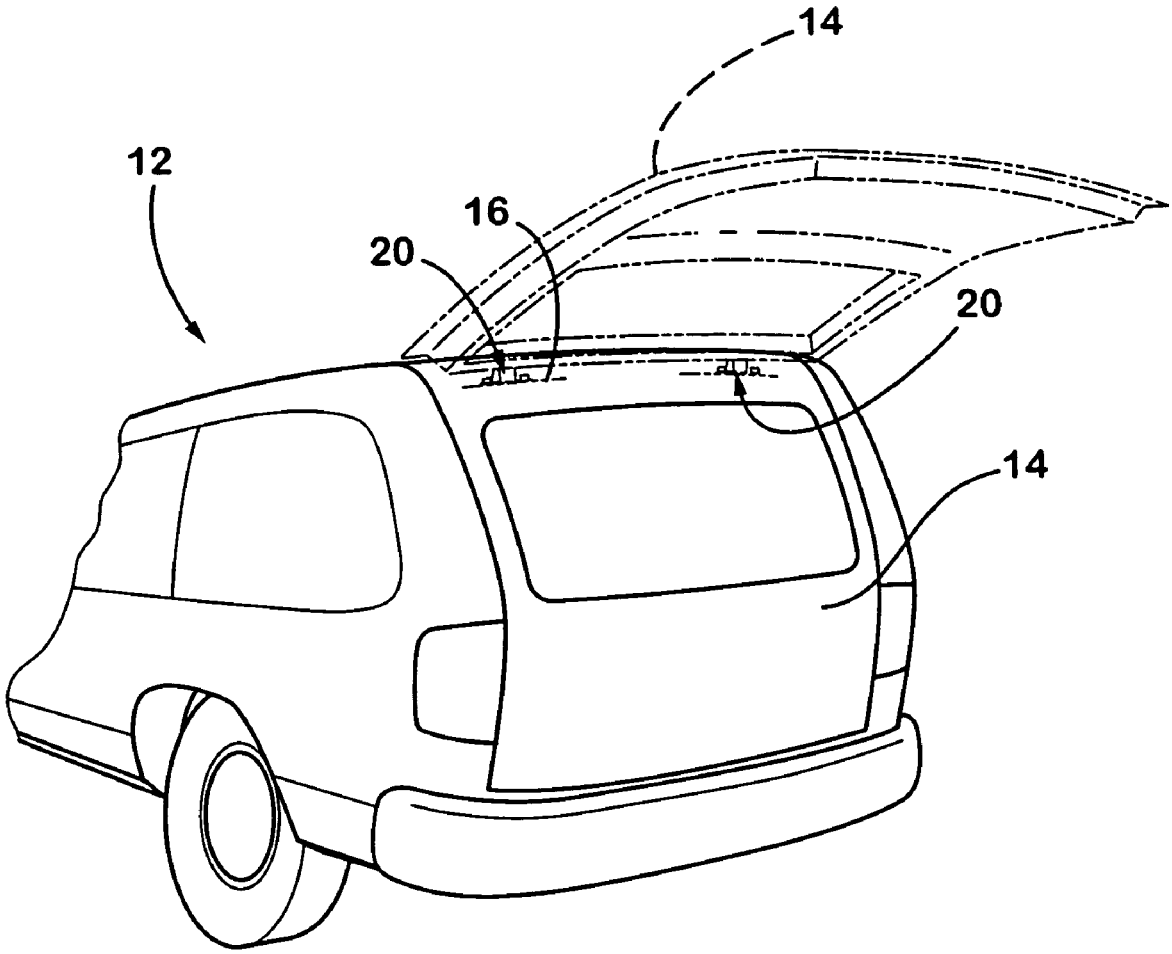
FIG. 1 is a perspective view of a vehicle incorporating a hinge in accordance with the present invention.

The present invention will now be described with reference to the accompanying figures, wherein the numbered elements in the following written description correspond to like-numbered elements in the figures. A hinge 20 according to a first embodiment of the invention is depicted in FIGS. 1–13. Hinge 20 includes a gate or panel attachment plate or portion 22 and a vehicle body attachment plate or portion 24. Gate attachment plate 22 is attached to a pivotable panel or gate 14 (such as a rear door or gate or hatch-back or other pivotable panel or the like, such as a window or door or deck lid or hood or the like) of a vehicle 12, while body attachment plate 24 is attached to a body or roof portion 16 of vehicle 12 (FIG. 1). Both gate attachment plate 22 and vehicle body attachment plate 24 are pivotably attached to an intermediate member 32, which allows the gate attachment plate 22 to pivot relative to the intermediate member 32, while also allowing the intermediate member to pivot relative to the body attachment plate 24. Intermediate member 32 may be configured to limit pivotal movement of the intermediate member relative to body attachment plate 24 and to limit pivotal movement of gate attachment plate 22 relative to intermediate member 32, as discussed below.

In practice, intermediate member 32 may be made from stamped metal, preferably stamped steel or the like, and may be stamped from a single piece of sheet metal. Because intermediate member 32 (and the attachment plates 22, 24) may be made from stamped metal, as opposed to extruded aluminum or other types of materials, the hinge 20 may have reduced costs associated with manufacturing of the intermediate member and the attachment plates, as well as reduced weight (because the steel component may be formed from a thinner sheet or plate than an aluminum component), all while still retaining sufficient structural strength. It will, however, be understood that intermediate member 32 can be made from other metals besides steel, and that it can be created by methods other than stamping, such as by molding or the like, or other techniques, without affecting the scope of the present invention.

Body attachment plate 24 comprises a plate portion 24*a* and a hinge portion 24*b* extending along a portion or edge of the plate portion 24*a*. Plate portion 24*a* includes a pair of mounting apertures or holes 25*a* for fasteners to extend therethrough for mounting the plate to the body of the vehicle. Although shown as threaded nuts 30 that may engage a bolt or stud extending through the openings 25*a*, the fasteners may otherwise comprise other types of fasteners, such as studs pressed through the openings 25*a* for extending through corresponding openings in the body portion of the vehicle or the like, for mounting or securing or attaching body attachment plate 24 to the vehicle body 16. Plate portion 24*a* also includes an aperture or opening 25*b* therethrough for receiving a fastener (not shown) therethrough for securing intermediate member 32 relative to body attachment plate 24, as discussed below. The plate portion 24*a* of body attachment plate 24 may also include a strengthening rib or gusset or the like to strengthen or enhance the structural rigidity of the body attachment plate 24.

Hinge portion 24*b* of body attachment plate 24 extends along a portion or edge of the plate portion 24*a* and may include one or more cylindrical hinge members or stamped curled portions for receiving a pivot pin 35 which defines a pivot axis 35*a* along hinge portion 24*b*. Pin 35 extends through the hinge portions 24*b* and also through openings in intermediate member 32 to pivotably mount or secure or attach intermediate member 32 to body attachment plate 24. Body attachment plate 24 may further include a stop portion 24*c* (FIG. 6) positioned generally between the spaced apart hinge portions 24*b* for engaging a corresponding stop portion 36 on intermediate member 32 to limit pivotal movement of intermediate member 32 relative to body attachment plate 24, as discussed below.

Panel attachment plate 22 may comprise a bent plate having a panel mounting portion 22*a* and a hinge mounting portion 22*b*. Panel mounting portion 22*a* may include holes or apertures 26 therethrough for mounting or attaching or securing the pivotable panel or gate 14 to mounting portion 22*a* via fasteners 28 (FIG. 3), such as studs or bolts or the like extending through openings 26 and secured to the panel attachment plate 22 and the gate or pivotable panel 14. For example, mounting portion 22*a* of gate attachment plate 22 may be secured to the gate or panel by studs or bolts secured to the gate or panel and having a threaded end protruding through holes 26 in gate attachment plate 22 for receiving a threaded fastener or nut thereon, or by studs pressed through the openings 26 for extending through corresponding openings in the gate or panel or the like, for mounting or securing or attaching gate attachment plate 22 to the gate or panel 14, or other types of fasteners, without affecting the scope of the present invention.

The hinge mounting portion 22*b* includes a hinge portion 22*c* comprising a pair of generally cylindrical hinge portions or stamped curled portions which receive a pivot pin 37 therethrough to define a pivot axis 37*a* between gate attachment plate 22 and intermediate member 32. The pin 37 extends through the hinge portions 22*c* and through corresponding openings or holes in intermediate member 32 to pivotably attach the gate attachment plate 22 to intermediate member 32. Hinge mounting portion 22*b* may include a stop portion 22*d* generally between the hinge portions 22*c* for engaging the stop members 38*a*, 38*b* of intermediate member 32, as discussed below. Gate attachment plate 22 may further include a rib or gusset or the like to strengthen or enhance the structural rigidity of the gate attachment plate to limit or resist twisting and bending of the plate during opening and closing of the gate of the vehicle.

Intermediate member 32 comprises an angled or bent member having a first or body plate leg or portion 33*a* and a second or gate plate leg or portion 33*b* arranged at an angle to one another. Intermediate member 32 is pivotably mounted at hinge portion 24*b* of body attachment plate 24 at the junction 33*c* of the legs 33*a*, 33*b* via pivot pin 35. Gate attachment plate 22 is similarly pivotably mounted to an outer end portion of leg 33*b* via pivot pin 37 extending through hinge portions 22*c* of gate attachment plate 22 and through the corresponding openings in or at or near the end of leg 33*b* of intermediate member 32. Intermediate member 32 may also include a stop member or members 36 (FIGS. 3–6) at or near the junction of the leg portions 33*a*, 33*b* for limiting pivotal movement of intermediate member 32 relative to body attachment plate 24, as discussed below. Likewise, intermediate member 32 may include a stop member or members 38*a*, 38*b* at an end of leg portion 33*b* to limit pivotal movement of gate attachment plate 22 relative to intermediate member 32, as also discussed below.

Figure 10:
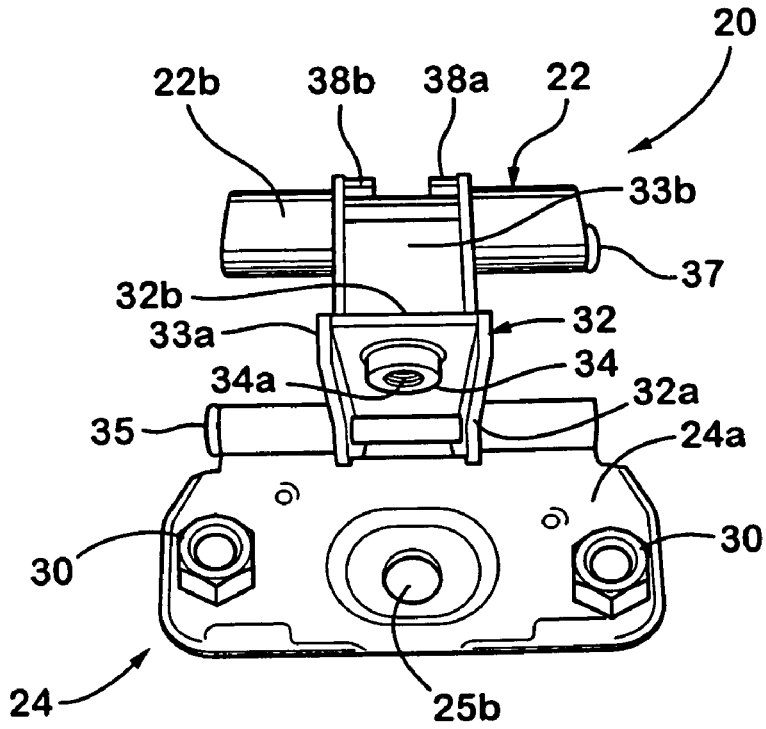
FIG. 10 is rear view of the hinge of FIGS. 2–9, with the hinge in its extended position.
Figure 11:
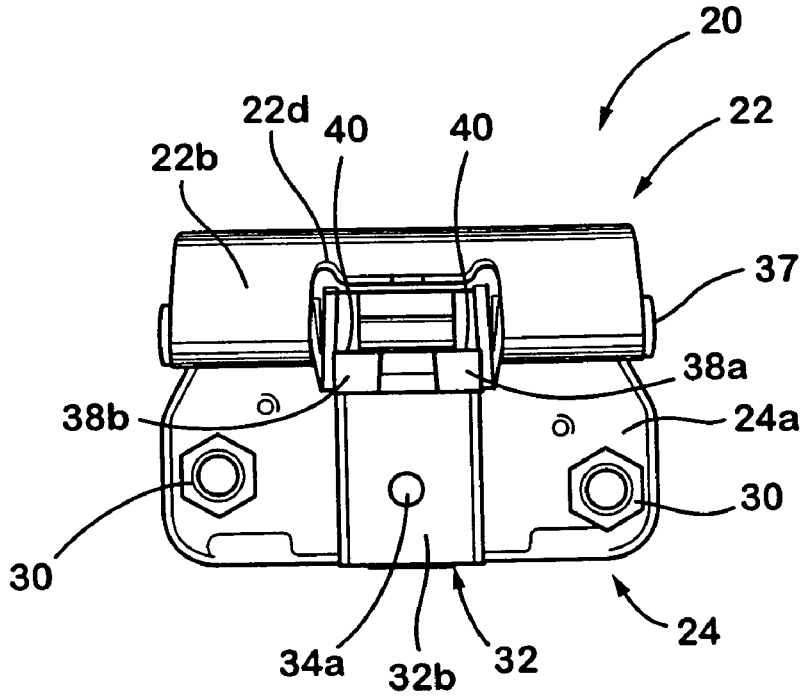
FIG. 11 is a top plan view of the hinge of FIGS. 2–10, similar to FIG. 7.
Figure 12:
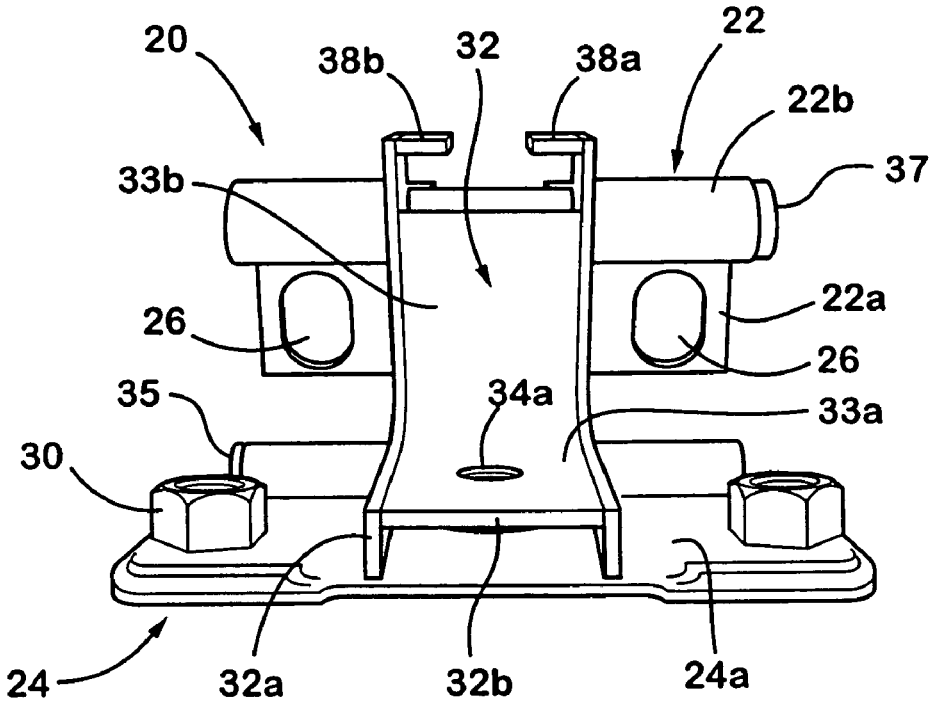
FIG. 12 is a rear elevation of the hinge of FIGS. 2–11.

Intermediate member 32 includes a pair of opposite sidewalls 32*a* and a central flange portion 32*b* extending along and generally between the sidewalls. The arrangement of the central flange 32*b* and sidewalls 32*a* provides enhanced structural rigidity and strength to intermediate member 32, in order limit or substantially preclude twisting or bending of the intermediate member during use of hinge 20. As can be seen in FIGS. 10 and 12, body plate leg 33*a* defines a generally inverted U-shaped member relative to plate portion 24*a* of body attachment plate 24. Accordingly, when intermediate member 32 is pivoted relative to body attachment plate 24 such that body plate leg 33*a* is positioned generally along and adjacent to and in engagement with plate portion 24*a*, the opposite sidewalls 32*a* along leg or portion 33*a* engage the surface of plate portion 24*a*, with the central flange 32*b* spaced from the plate portion 24*a* (as best shown in FIG. 12).

A fastener portion 34 of intermediate member 32 may extend partially between the central flange 32*b* and plate portion 24*a* when intermediate member 32 is pivoted to the retracted position relative to body attachment plate 24. Fastener portion 34 is adapted to receive a fastener (not shown) that secures intermediate member 32 to vehicle body attachment plate 24 in a non-pivoting manner. For example, fastener portion 34 may comprise a threaded hole or opening or passageway 34*a* extending at least partially therethrough, such that a fastener may be inserted through hole 25*b* in body attachment plate 24 and threadedly engage threaded opening 34*a* of fastener portion 34 of intermediate member 32. As the fastener is tightened and secured in fastener portion 34, the leg 33*a* of intermediate member 32 is tightly secured to plate portion 24*a* of body attachment plate 24. The inverted U-shape arrangement of the leg 33*a* along plate portion 24*a* substantially enhances the strength and structural rigidity of the hinge 20 and substantially resists twisting and/or bending of the intermediate member 32 during use of the hinge. The inverted U-shaped arrangement of the present invention thus provides a hinge member having enhanced strength, while allowing the hinge member to be formed from a stamped piece of sheet metal or the like.

Second leg or portion 33*b* of intermediate member 32 is pivotably mounted to gate attachment plate 22 via pivot pin 37. Second leg 33*b* includes a pair of stop portions 38*a*, 38*b* for engaging stop portions 22*d* of gate attachment plate 22 to limit pivotal movement of the gate attachment plate 22 relative to intermediate member 32. Stop members 38*a*, 38*b* extend from the sidewalls 32*a* of leg portion 33*b* and extend beyond the openings or holes in the leg portion 33*b* for receiving pivot pin 37. The stop portions 38*a*, 38*b* may be formed to initially extend substantially rearwardly toward the gate attachment plate 22, and may then be adjusted or cut or trimmed to adjust the stop portions to accommodate different degrees of pivotal movement of gate attachment plate 22 relative to intermediate member 32. The stop members 38*a*, 38*b* thus may limit how far the vehicle gate can be opened by engaging the stop portions 22*d* of gate attachment plate 22 as the gate attachment plate (and the gate) pivot to the desired fully opened position.

Figure 13:
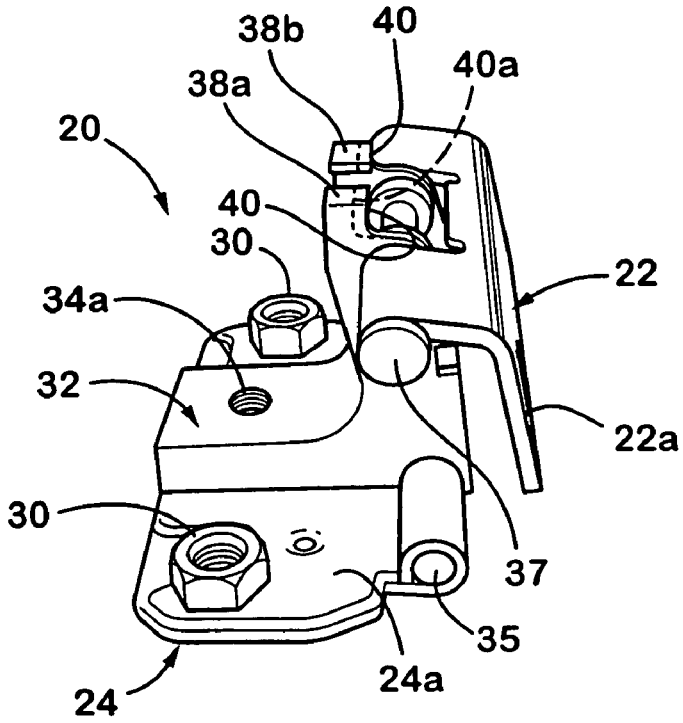
FIG. 13 is a perspective view of the hinge of FIGS. 2–12, with a modified stop (in phantom)

The stop members 38*a*, 38*b* may limit pivotal movement of the gate attachment plate 22 via engagement of edges 40 of stop members 38*a*, 38*b* with stop portion 22*d* of gate attachment plate 22, and may limit the pivotal movement at different positions by having the stop members 38*a*, 38*b* cut or trimmed to different sizes during the manufacture of the hinge 20. For example, a greater amount or portion of material may be trimmed from the stop members 38*a*, 38*b* to create a greater pivotal range of motion of the gate attachment plate 22 relative to the intermediate member 32, or a lesser amount or portion of material may be trimmed from the stop members 38*a*, 38*b* to create a lesser pivotal range of motion of the gate attachment plate 22 relative to the intermediate member 32. For example, FIG. 13 illustrates an alternative position for edges 40*a* (shown in dashed lines). When edges 40*a* are trimmed in this manner, gate attachment plate 22 will contact edges 40*a* later than it would if the edges were trimmed to the level shown in FIG. 5, and therefore will limit the upward pivoting of gate attachment plate 22 at a greater range of pivotal movement. Intermediate member 32 thus may comprise a common part or common parts for different vehicles or vehicle lines, whereby the stop members 38*a*, 38*b* may be adjusted or trimmed a desired amount to adapt the intermediate member to each particular application, depending on the desired amount of pivotal movement of the gate or/and gate attachment plate.

During use of hinge 20, body attachment plate 24 may be mounted or secured to the body portion 16 of a vehicle 12, such as a rear portion of a roof of the vehicle, via the mounting fasteners (such as studs or bolts and nuts 30 or other fasteners or the like) as shown in FIG. 1. The gate attachment plate 22 may be mounted or secured to the lift gate or tail gate 14 of the vehicle 12, such that the gate 14 may be pivotably mounted to the rear portion of the vehicle and pivotable about the generally horizontal pivot axis 37*a* between gate attachment plate 22 and intermediate member 32. Although shown and described as pivotably mounting a lift gate or tail gate to a vehicle body, the hinge of the present invention may be equally suitable for mounting other pivotable doors or panels (such as, for example, a window, a deck lid, a hood, a door or the like) to a vehicle body, without affecting the scope of the present invention.

Figure 2:
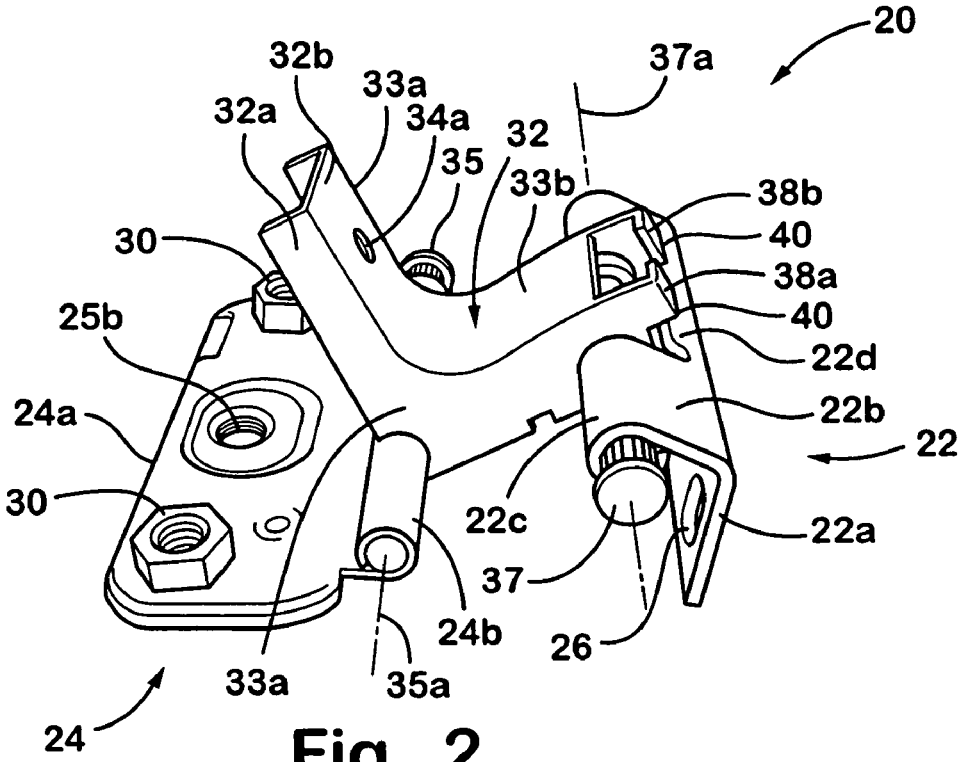
FIG. 2 is a perspective view of a hinge in accordance with the present invention, with the hinge shown in an extended position.
Figure 3:
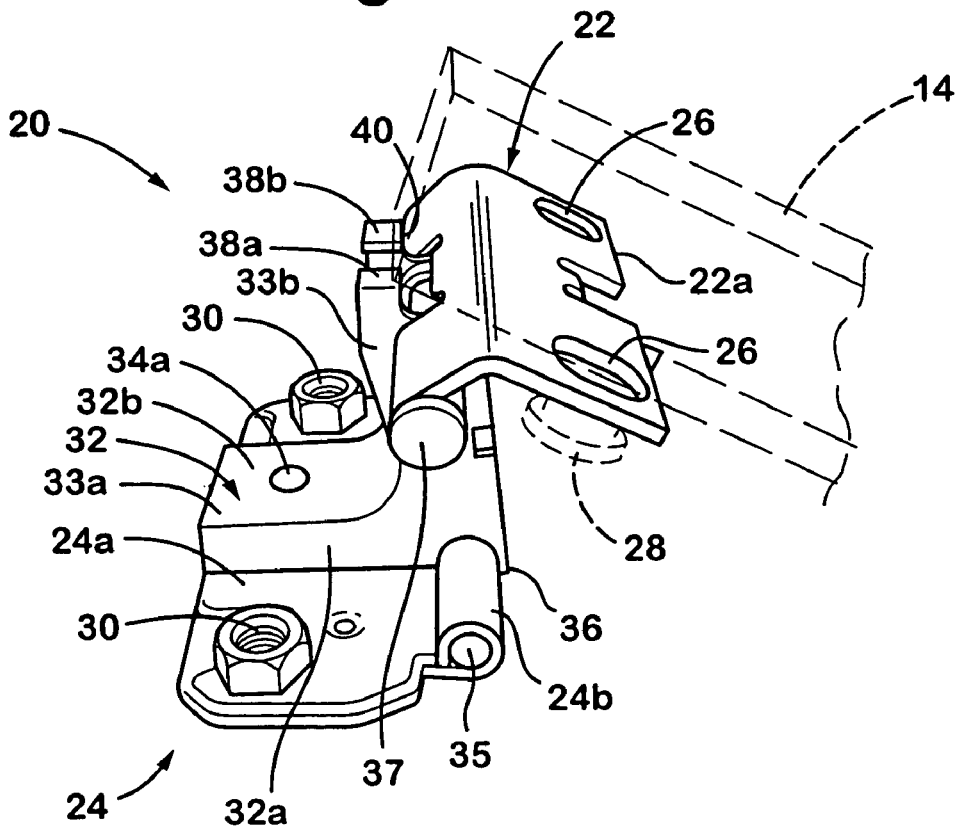
FIG. 3 is a perspective view of the hinge of FIG. 2, with the intermediate member in a retracted position.

After the gate 14 and hinge 20 are installed to the vehicle body 16, intermediate member 32 (and gate attachment plate 22 and gate 14) may pivot about the pivot axis 35*a* with respect to body attachment plate 24 into an extended position (FIGS. 2 and 10). Such pivotal movement of the hinge may be desired during the manufacture of the vehicle, such as during the painting of the vehicle on the vehicle assembly line. In the extended position, more clearance is provided to ensure that paint is received over all of the components of hinge 20, as well as over all of the external surfaces of the vehicle body 16 and gate 14. First stop member or members 36 (FIG. 6) limits the pivoting of the intermediate member 32 with respect to vehicle body attachment plate 24 by abutting against a stop portion 24*c* of body attachment plate 24.

After painting, intermediate member 32 may be pivoted back, such that sidewalls 32*b* of leg portion 33*a* are in contact with the plate portion 24*a* of vehicle body attachment plate 24. Intermediate member 32 may then be permanently or fixedly secured to body attachment plate 24 via insertion of the fastener through the aligned hole 24*b* in body attachment plate 24 and at least partially through fastener portion 34 of center wall or flange 32*a* of intermediate member 32. Thereafter, hinge 20 may pivot only about pivot axis 37*a* at the junction between intermediate member 32 and gate attachment plate 22.

Figure 4:
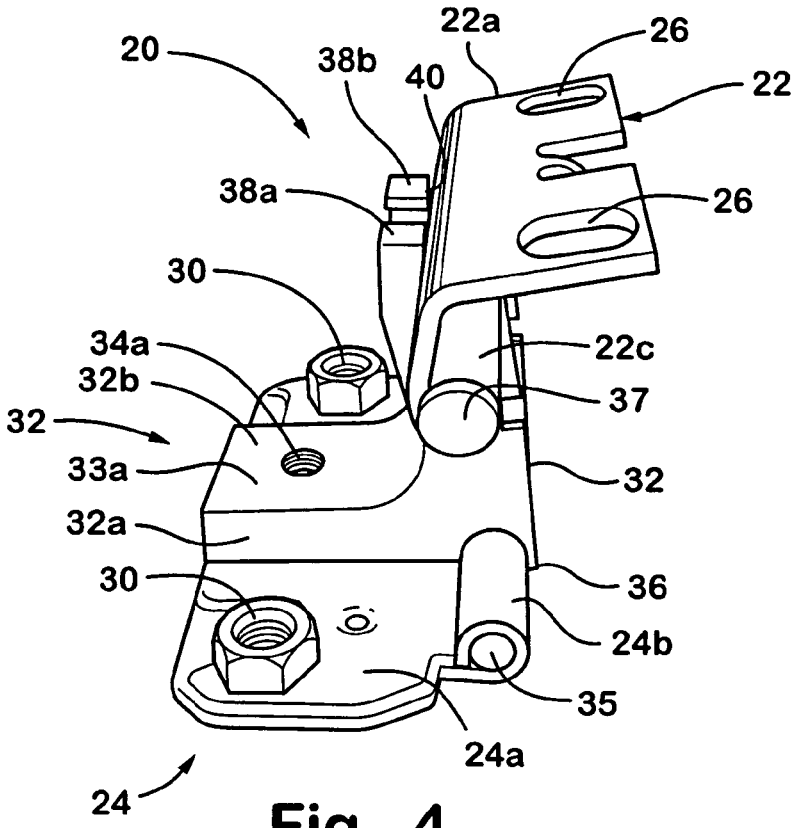
FIG. 4 is a perspective view of the hinge of FIGS. 2 and 3, with the intermediate member in the retracted position and the gate attachment plate or portion pivoted to its uppermost limit.
Figure 5:
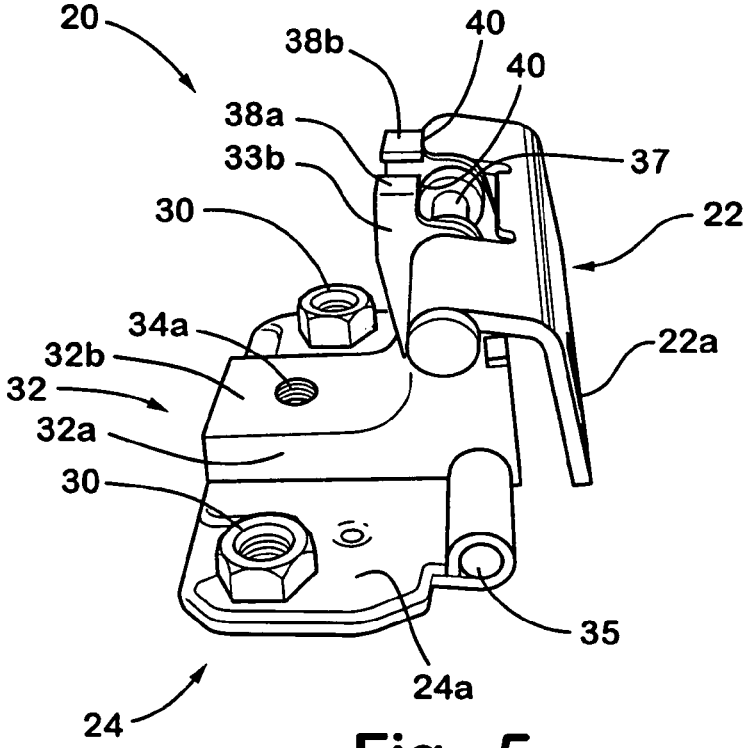
FIG. 5 is a perspective view of the hinge of FIGS. 2–4, with the intermediate member in the retracted position and the gate attachment plate pivoted to its downward-most position.
Figure 6:
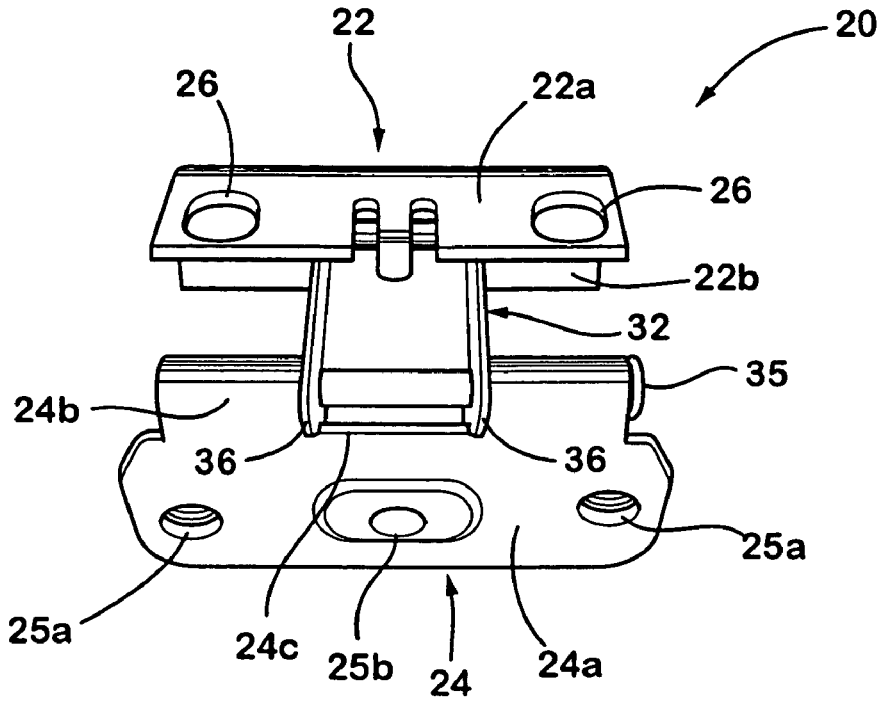
FIG. 6 is a front elevation of the hinge of FIGS. 2–5, illustrating the stops for the extended position of the hinge.
Figure 7:
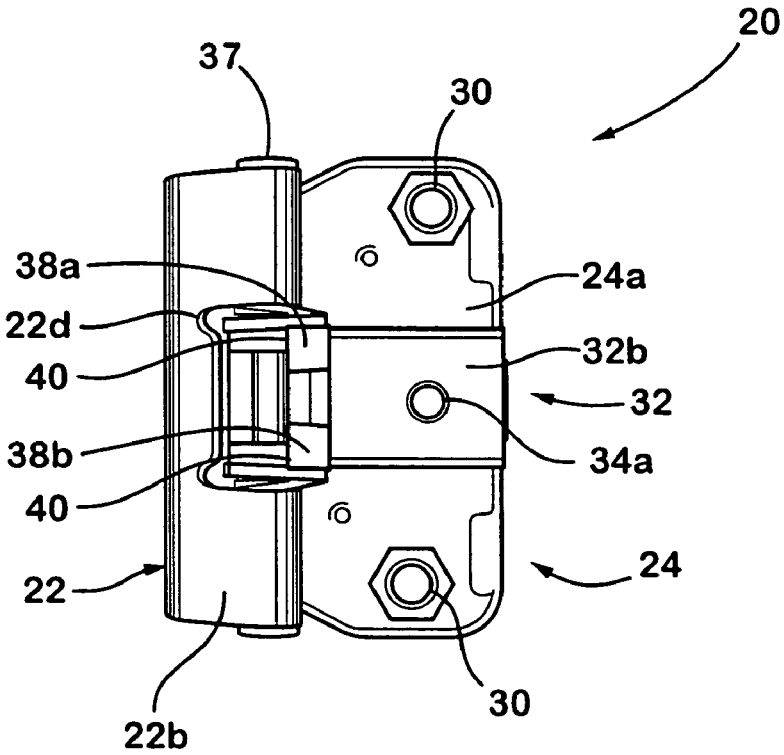
FIG. 7 is a plan view of the hinge of FIGS. 2–6, with the gate attachment plate pivoted to its downward-most position.
Figure 8:
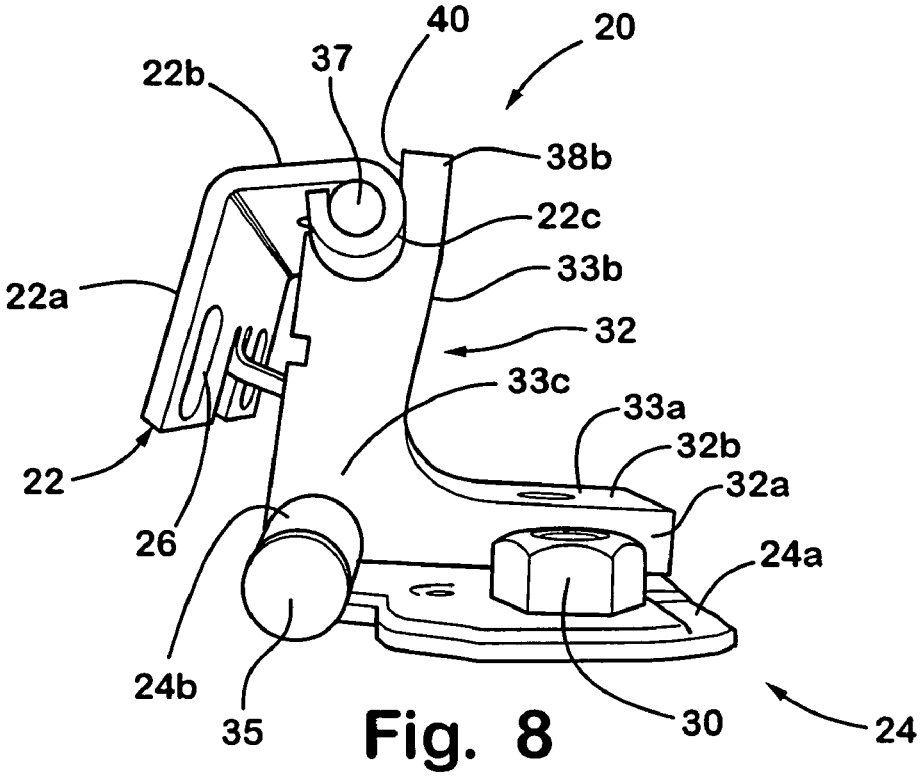
FIG. 8 is a side elevation of the hinge of FIGS. 2–7, with the gate attachment plate pivoted to its downward-most position.
Figure 9:
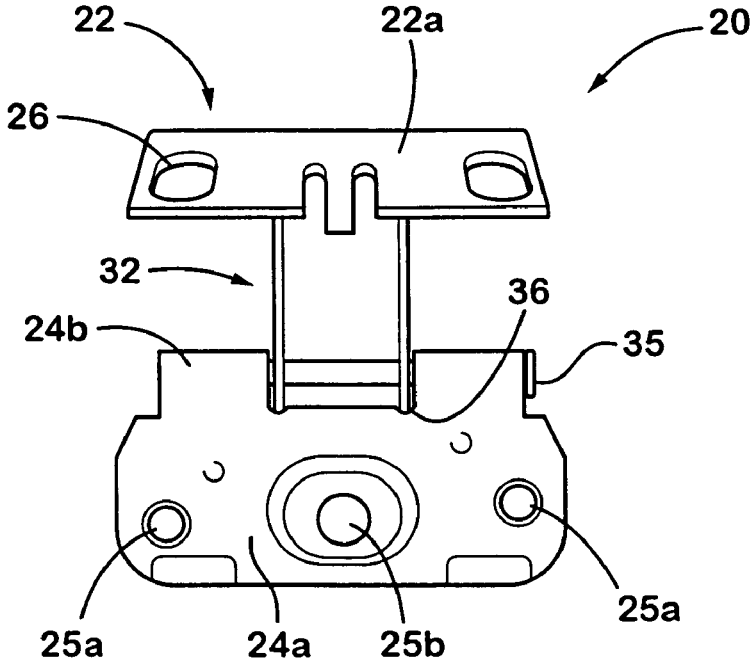
FIG. 9 is a lower plan view of the hinge of FIGS. 2–8, illustrating the stops for the extended position of the hinge wherein the hinge is pivoted to its extended position.

Intermediate member 32 also includes at least one second stop, which, in the illustrated embodiment, is made up of a right stop 38*b* and a left stop 38*a*. Second stop or stops 38*a*, 38*b* limits the upward pivoting of gate attachment plate 22 with respect to intermediate member 32. Second stop 38*a*, 38*b* thus limits how far a vehicle gate can be opened before the gas struts are mounted to the vehicle. Second stop 38*a*, 38*b* limits the pivotal movement of gate attachment plate 22 by way of edges 40 that abut against gate attachment plate 22 when it is pivoted to it upward-most position (FIG. 4). Second stop 38*a*, 38*b* can be manufactured to limit the angle of this upward-most position at different angular positions by trimming edges 40 in different manners.

The trimming of edges 40 at different positions may be readily accomplished during the manufacturing process by simply changing one or more punches. The punches are aligned generally parallel to the axis 37*a* about which gate attachment plate 22 pivots. By cutting away more material from intermediate member 32 adjacent to stops 38*a*, 38*b*, the stops 38*a*, 38*b* are made smaller (as shown in FIG. 13), and more range is given to the pivotal movement of the vehicle gate about pivot axis 37*a*. By cutting away less material, stops 38*a*, 38*b* are made larger and contact gate attachment plate 22 sooner, thereby providing a more limited range of pivotal movement of the vehicle gate. Regardless of the desired size of stops 38*a*, 38*b*, intermediate member 32 can be manufactured starting from the same single piece of sheet metal or from the same stamped member. All of the same tooling can be used to create the intermediate members for multiple hinges with the exception of simply changing the punch used to trim or size stops 38*a*, 38*b*. The manufacturing of hinges to accommodate different vehicle models is therefore greatly simplified. The same starting materials and virtually the same tooling is used to create a variety of different types of hinges. Although shown and described as having an adjustable or trimmable intermediate member, it is envisioned that the range of pivotal movement of the gate attachment plate relative to the intermediate member may be adjusted via trimming or modifying the stop portion of the gate attachment plate, such as by cutting or forming grooves of different depths for receiving the stop tabs or members of the intermediate member, without affecting the scope of the present invention.

Figure 14:
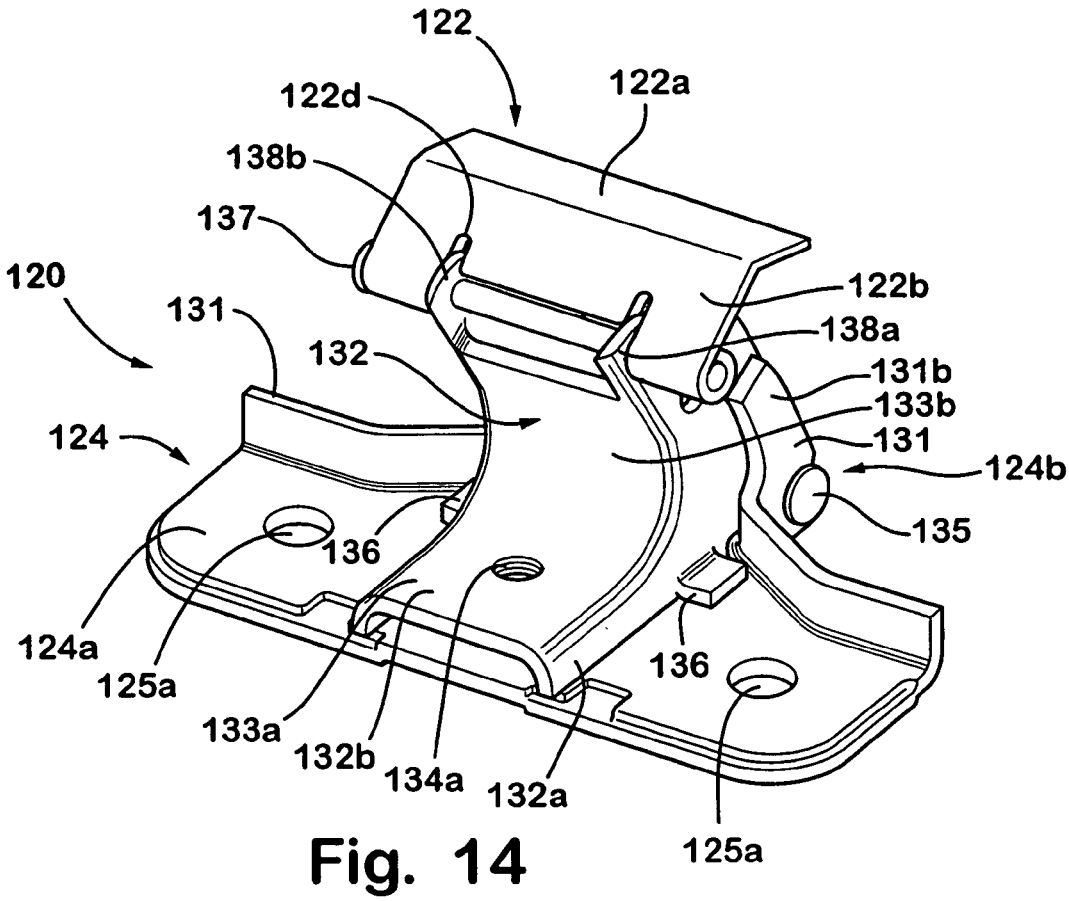
FIG. 14 is a perspective view of another hinge in accordance with the present invention.
Figure 15:
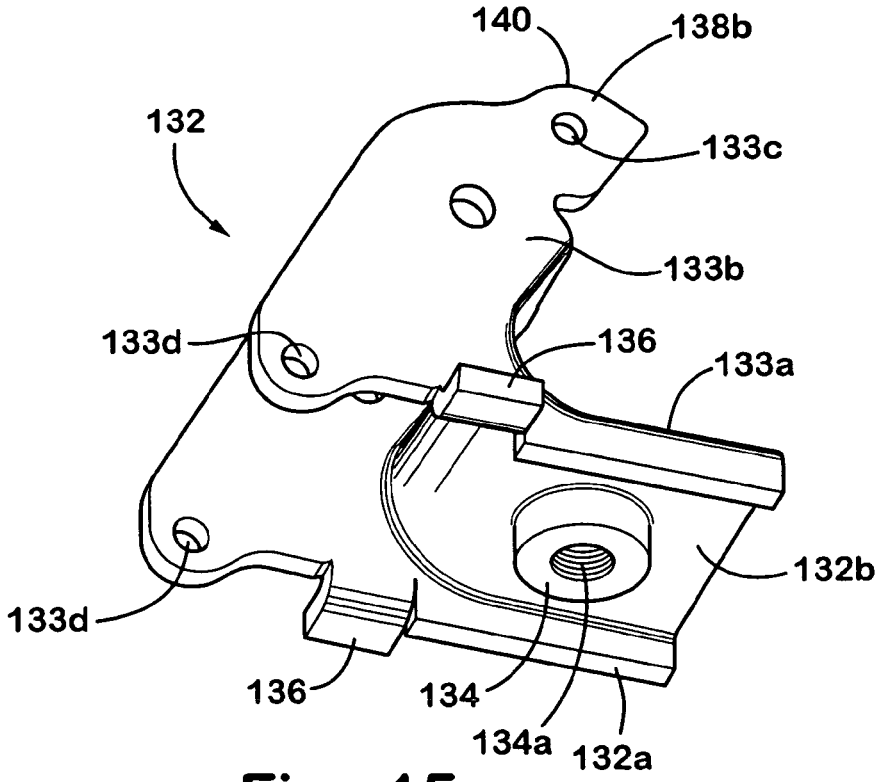
FIG. 15 is a perspective view of the intermediate section of the hinge of FIG. 14.
Figure 16:
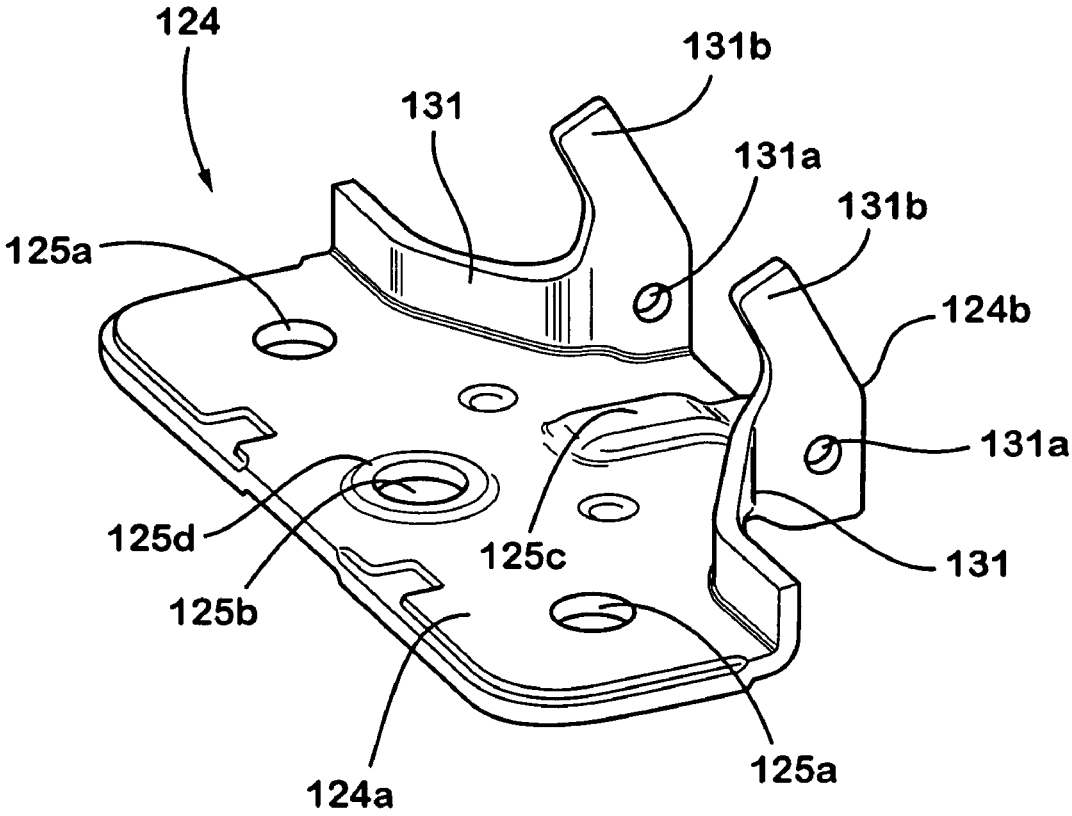
FIG. 16 is a perspective view of the body attachment plate of the hinge of FIG. 14.

Referring now to FIGS. 14–16, a hinge 120 includes a body attachment plate 124 and a gate or panel attachment plate 122 and an intermediate member 132 pivotably mounted to body attachment plate 124 and gate attachment plate 122. Hinge 120 is substantially similar to hinge 20, discussed above, such that a detailed discussion of the hinge will not be repeated herein. The similar or common components or features of the hinge 120 are referenced with similar reference numbers in FIGS. 14–16, but with 100 added to each reference number. As described above with respect to hinge 20 (and as shown generally in FIG. 1), the gate attachment plate 122 of hinge 120 is attached to a pivotable panel or gate (such as a rear door or gate or hatch-back or other pivotable panel or the like, such as a window or door or deck lid or hood or the like) of a vehicle, while the body attachment plate 124 is attached to a body or roof portion of the vehicle. Body attachment plate 124 may be positioned at a rearward end of the body or roof portion of the vehicle such that a rearward or hinge portion 124*b* of body attachment plate 124 may overhang or extend from the rearward end of the body or roof portion and, thus, may be unsupported by the body or roof portion of the vehicle.

Body attachment plate 124 includes a plate portion 124*a* and hinge portions 124*b* for pivotably mounting intermediate member 132 to body attachment plate 124. Body attachment plate 124 comprises at least one raised wall or flange 131 extending generally vertically upwardly from and at least partially along an edge or portion of plate portion 124*a*. Flange 131 extends along the rear edge portion and extends at an angle to (such as generally orthogonal or transverse to) the rear edge or edge portion of the plate portion and generally rearwardly to define spaced apart and opposed hinge portions 124*b*. The hinge portions 124*b* include openings or apertures 131*a* (FIG. 16) for receiving a pivot pin or member 135 therethrough to pivotably mount the intermediate member to the body attachment plate.

In the illustrated embodiment of FIGS. 14–16, the at least one wall or flange comprises two flange portions 131 along opposite portions of the rear edge of the body attachment plate. Each of the flange portions curves generally rearwardly near the center region of the plate to define a respective one of the spaced apart and opposed hinge portions 124*b* of body attachment plate 124. The generally rearwardly extending raised hinge portions 124*b* provide enhanced structural rigidity to the body attachment plate to limit or substantially preclude downward flexing or bending of the hinge portion and/or plate portion during pivotal movement of the intermediate member 132 (and the gate attachment plate and gate) relative to the body attachment plate 124 and/or pivotal movement of the gate attachment plate (and gate) relative to the intermediate member 132. This enhanced structural rigidity or support is especially beneficial/desired for applications where the hinge portion 124*b* of body attachment plate 124 may extend rearward of the vehicle body or roof portion 16 and may thus be substantially non-supported by the vehicle body. Because the hinge portions 124*b* are spaced apart, the body attachment plate of the present invention also provides clearance or room for a ridge or gusset 125*c* or the like to be formed in plate portion 124*a* to further enhance the strength and overhang rigidity of the body attachment plate 124. Although shown and described as extending along the rear edge of the plate portion, the flange or wall portions of the body attachment plate may extend along the plate portion inward of the edge (such as generally along the rear portion or region of the plate) and then extend at an angle to or generally transverse to the rear portion to define the hinge portions 124*b*, without affecting the scope of the present invention.

The flange portion 131 thus may have a portion or wall that extends generally along the rear edge or portion of the plate portion 124*a* to provide enhanced strength and structural rigidity to the body attachment plate 124, and may have a hinge portion 124*b* that extends or curves at an angle to or in a direction generally transverse to the edge portion to provide further rigidity and resistance to flexing or bending or twisting of the body attachment plate during opening and closing of the lift gate of the vehicle. The angularly disposed portions of the flanges 131 may thus provide resistance to flexing or bending of the plate in multiple directions to enhance the structural rigidity of the body attachment plate. The generally vertical walls or flanges 131 and hinge portions 124*b* also may provide structural support for the cross car location of the intermediate member sidewalls 133*b* and may provide enhanced rigidity to the body attachment plate for the overhang of the hinge portions for applications where the hinge portion is not supported by a vehicle body portion. The hinge portions 124*b* of flanges 131 may further include upwardly extending protrusions or stop portions 131*b* generally at or adjacent to openings 131*a*. The stop portions 131*b* function to limit pivotal movement of intermediate member 132 relative to body attachment plate 124, as discussed below.

Intermediate member 132 may be substantially similar to intermediate member 32, discussed above, and includes angularly disposed legs or portions 133*a*, 133*b*, and a central flange portion 132*b* extending along and between opposite sidewalls or side portions 132*a*. Leg portion 133*b* is pivotably mounted to body attachment plate 124, such as via a pivot pin 135 extending through holes 131*a* in the spaced apart and opposed hinge portions 124*b* of the flanges 131 of body attachment plate 124 and through holes 133*d* (FIG. 15) in intermediate member 132. Leg portion 133*a* may include a pair of stop members 136 which extend outwardly from sidewalls 132*a*. The stop members 136 may engage the stop members 131*b* of body attachment plate 124 to limit pivotal movement of intermediate member 132 relative to body attachment plate 124 (such as when the intermediate member is pivoted relative to the body attachment plate for the paint process at the vehicle assembly plant, and before the intermediate member is secured to the body attachment plate, such as via a fastener or bolt or the like).

As best shown in FIG. 15, a fastener portion 134 may extend downwardly from central flange portion 132*b*, such that when the fastener is inserted through the opening 125*b* (FIG. 16) in body attachment plate 124 and threadedly engages the threaded opening 134*a* of mounting portion 134, the fastener may pull downward on the mounting portion 134 and central flange 132*b* to pull the sidewalls 132*a* into engagement with the surface of the plate portion 124*a* of body attachment plate 124. The body attachment plate may have an upwardly protruding portion 125*d* around the opening 125*b*, such that the fastener portion 134 may contact the upwardly extending portion 125*d* to substantially positively position the intermediate member 132 relative to body attachment plate 124 and to substantially secure the fastener in position within the threaded opening 134*a*.

The other leg portion 133*b* of intermediate member 132 pivotably receives or is mounted to gate attachment plate 122, such as via a pivot pin or member 137 extending through holes 133*c* (FIG. 15) in leg portion 133*b*. Leg portion 133*b* includes a pair of stop members 138*a*, 138*b* extending from the sidewalls 132*a* of leg portion 133*b* for engaging the stop portion 122*d* of the gate attachment plate 122, such as in a similar manner as described above. As also described above with respect to hinge 20 of FIGS. 2–13, the stop members 138*a*, 138*b* of hinge 120 may be adjusted or trimmed to adjust the range of pivotal movement of gate attachment plate 122 relative to intermediate member 132, and thus of the gate or panel or pivotable component relative to the vehicle body. For example, the edges 140 of stops 138*a*, 138*b* may be trimmed or adjusted to adjust the stopping position of the gate attachment plate 122 relative to intermediate member 132. The hinge 120 thus may provide for adjustment of the pivotal range of the hinge during manufacturing of the hinge, and particularly during manufacturing of the intermediate member.

Figure 23:
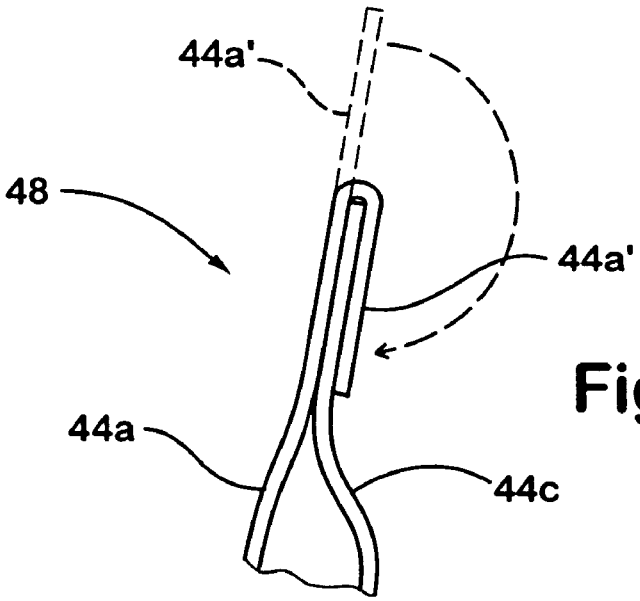
FIG. 23 is an enlarged elevation of the thickened end of the hinge component of FIGS. 17–22
Figure 17:
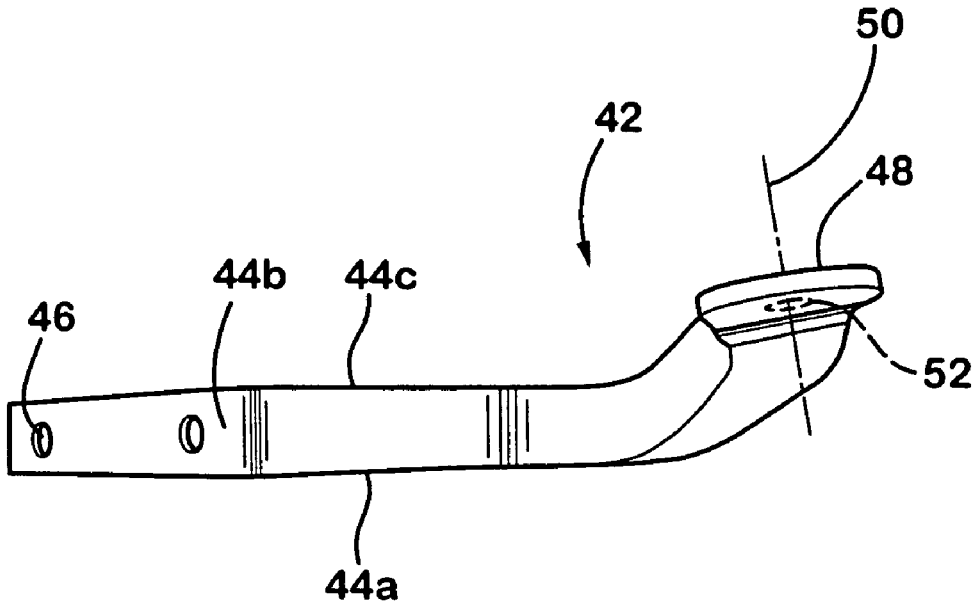
FIG. 17 is a plan view of a top of another hinge component in accordance with the present invention.
Figure 18:
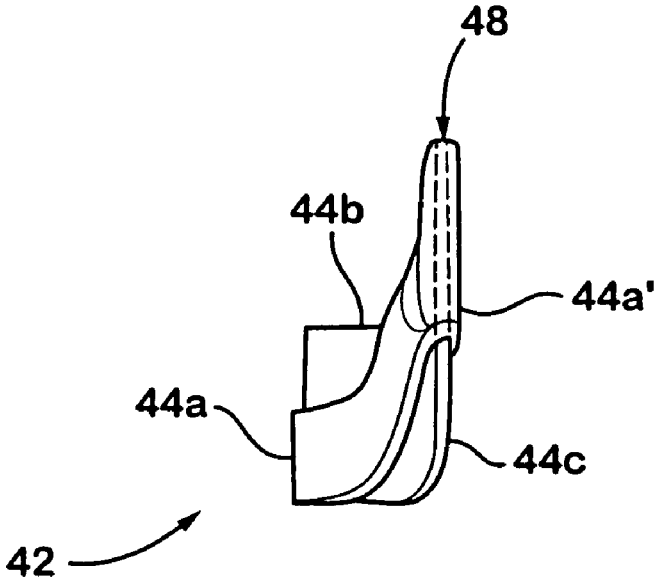
FIG. 18 is a front elevation of the hinge component of FIG. 17.
Figure 19:
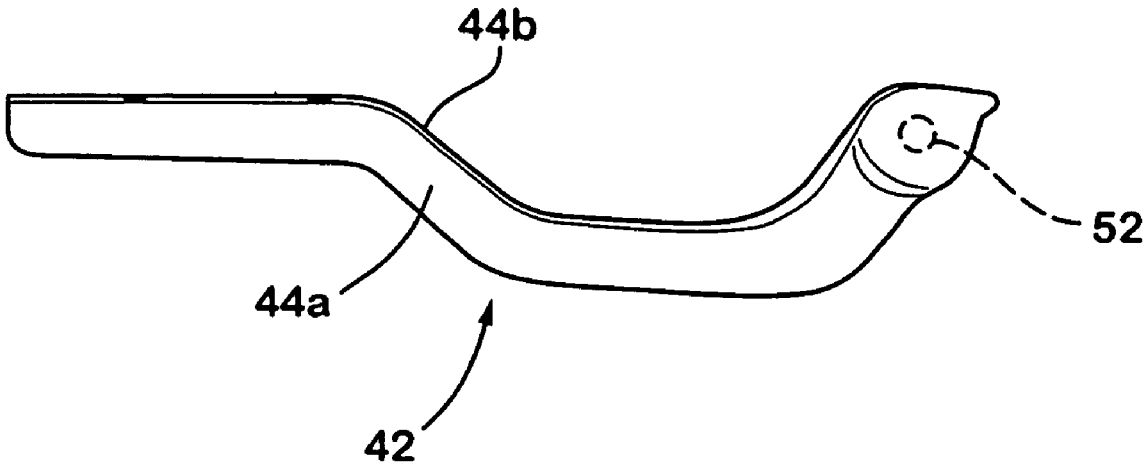
FIG. 19 is a side elevation of the hinge component of FIGS. 17 and 18.
Figure 20:
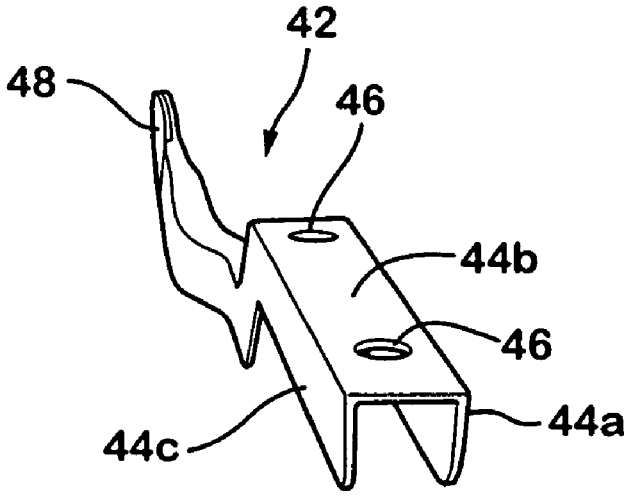
FIG. 20 is a rear elevation of the hinge component of FIGS. 17–19.
Figure 21:
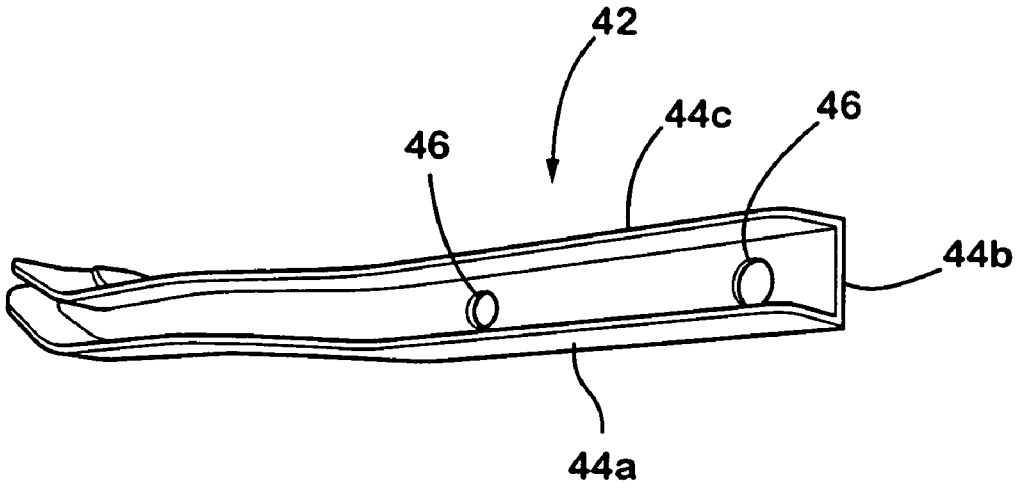
FIG. 21 is a plan view of the underside of the hinge component of FIGS. 17–20.
Figure 22:
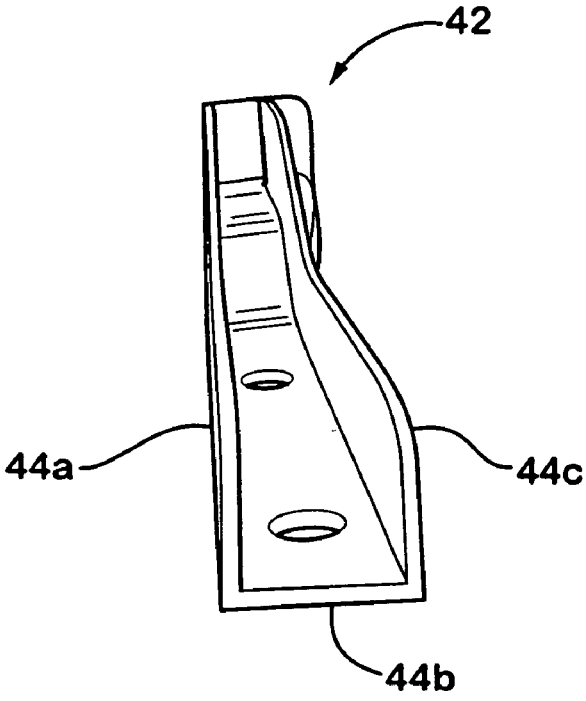
FIG. 22 is a rear elevation of the hinge component of FIGS. 17–21, with the hinge component in an upside-down orientation with respect to FIG. 20.

Referring now to FIGS. 17–23, a hinge component 42 may be especially adapted to be attached to a hood or trunk of a vehicle (not shown in FIGS. 17–23). Hinge component 42 is preferably made from a single, stamped piece of metal, such as steel or the like. Hinge component 42 includes three walls 44*a*, 44*b*, 44*c*, which are arranged to form a generally U-shaped channel. The U-shape provides comparable strength to a tubular product, yet allows hinge component 42 to be stamped, thereby reduces the manufacturing cost of the hinge component 42. One end of hinge component 42 includes one or more fastener holes 46 which receive fasteners used to secure component 42 to a vehicle pivotable panel, such as a hood of the vehicle or the like. The other end of hinge component 42 is crimped such that the two sidewalls 44*a* and 44*c* of the U-shaped channels are in planar contact with each other. This region of planar contact forms a thickened region 48, as best shown in FIG. 23.

The thickened region 48 may define a pivot axis 50 of the hinge component 42 for the hood or deck lid and hinge component 42 to pivot about when the hood or deck lid and hinge component 42 are mounted to the vehicle body. A hole 52 can be net pierced in thickened region 48 to receive a bushing, which in turn receives a pivot pin that defines a pivot axis about which hinge component 42 will pivot. This net piercing may take place on the vehicle assembly line after hinge component 42 has been attached to a hood, trunk cover or deck lid, or other pivotable panel or component or item. After attachment to the pivotable component, the pivotable component can be placed in proper alignment on the vehicle body and the hole net pierced so that proper alignment of the pivotable component is ensured with respect to the vehicle body.

For example, hinge component 42 may be attached to a hood. The hood may then be aligned properly with the vehicle body so that when it is closed, it is aligned and evenly spaced about the vehicle body. The hole 52 in hinge component 42 may then be pierced while the hood is properly aligned. A bushing 54 may then be put in the hole, and a pivot pin (not shown) on the body of the vehicle may be inserted through the bushing and hole to pivotably mount the hinge component 42 (and the hood) to the vehicle body. Two hinge components 42 may be used with a single hood to provide hinged support on both sides of the hood (or other pivotal component or item, such as a deck lid or the like).

Thickened region 48 of hinge component 42 is preferably thick enough to provide sufficient structural strength and resistance to wear over the life of the vehicle. If the thickness of sidewalls 44*a*, 44*c* are less than one half of the desired thickness of thickened region 48, then thickened region 48 may not be thick enough in the illustrated embodiment. In order to accommodate a desired greater thickness in thickened region 48, one of sidewalls 44*a* or 44*c* (such as 44*a* in FIG. 23) may be designed to initially extend beyond the terminus of the other sidewall (as shown in phantom at 44*a*' in FIG. 23). This extended portion of the sidewall can then be folded back over onto the two sidewalls in thickened region 48, thereby creating a thickened region having a thickness equal to the thickness of three sidewalls 44*a*, 44*c* and 44*a*' Additional foldings can be made to provide even thicker regions 48, if desired.

Therefore, the present invention provides a hinge for an automobile that may be formed from stamped metal components, yet may be substantially strong and structurally rigid to withstand the forces encountered in opening and closing a pivotable panel, such as a tailgate or lift gate or hatchback or deck lid or the like of a vehicle. The hinge of the present invention may be used on different vehicles where a desired range of pivotal movement of the pivotable panel may be different between the different vehicles or vehicle lines. The intermediate member or gate attachment plate may be adjusted or trimmed to provide different stop locations of the gate relative to the body portion of the vehicle. The intermediate members (and attachment plates) thus may be common parts across different vehicles or vehicle lines and may be adjusted to adapt the particular hinge to the particular application of that hinge. Also, the generally inverted U-shaped design of the intermediate member provides for enhanced structural rigidity of the intermediate member and thus of the hinge over conventional designs. Also, the body attachment plate of the hinge of the present invention may be formed to substantially enhance the structural rigidity of the plate to resist or limit or substantially preclude flexing or bending or twisting of the plate and hinge during use of the hinge.

It is to be understood that the foregoing is a description of the preferred embodiments only. One skilled in the art will recognize that variations, modifications and improvements may be made without departing from the spirit and scope of the invention disclosed herein. The scope of protection is to be measured by the claims which follow and the breadth of interpretation which the law allows, including the doctrine of equivalents.

What is claimed is:

1. An automobile hinge for pivotably mounting a pivotable panel component to a vehicle body, said automobile hinge comprising:

a panel attachment plate adapted to be secured to a pivotable panel of a vehicle, said panel attachment plate comprising a stamped metallic plate;

a body attachment plate adapted to be secured to a vehicle body, said body attachment plate comprising a stamped metallic plate;

an intermediate member pivotably attached to said body attachment plate, said panel attachment plate being pivotably attached to said intermediate member, said intermediate member comprising a stamped metallic member having first and second portions arranged at an angle relative to one another, each of said first and second portions of said intermediate member having a generally U-shaped cross section along substantially an entire length thereof and each of said first and second portions comprising opposite sidewalls and a center flange extending between said opposite sidewalls, said intermediate member being pivotably attached to said body attachment plate at a junction of said first and second portions, said junction having opposite sidewalls that pivotally attach to said body attachment plate, said sidewalls of said first portion engaging said body attachment plate with said center flange of said first portion being spaced from said body attachment plate when said intermediate member is pivoted toward a first position where said first portion of said intermediate member is positioned generally along said body attachment plate, said intermediate member being securable in said first position relative to said body attachment plate; and wherein said body attachment plate comprises a generally planar plate portion and a pair of raised flanges along an edge region of said plate portion, said body attachment plate having a hinge portion, said hinge portion comprising a pair of opposed flanges extending generally transverse to said raised flanges, said raised flanges and said opposed flanges extending generally vertically when said plate portion is generally horizontal.

2. The automobile hinge of claim 1, wherein said panel attachment plate is pivotably attached to said intermediate member at an end of said second portion opposite said junction of said first and second portions.

3. The automobile hinge of claim 2, wherein said intermediate member includes a panel stop member at said end that is configured to engage a portion of said panel attachment plate to limit pivotal movement of said panel attachment plate.

4. The automobile hinge of claim 1, wherein said intermediate member includes a body plate stop member that is configured to engage a portion of said body attachment plate to limit pivotal movement or said intermediate member away from said first position.

5. The automobile hinge of claim 4, wherein said body plate stop member comprises at least one flange protruding outwardly from said first portion of said intermediate member and in a direction generally transverse to a longitudinal axis of said first portion, said at least one flange being configured to engage a corresponding flange extending from said body attachment plate.

6. The automobile hinge of claim 1, wherein said intermediate member includes at least one panel stop member that is configured to engage a stop portion of said panel attachment plate to limit pivotal movement of said panel attachment plate.

7. The automobile hinge of claim 6, wherein at least one of said panel stop member and said stop portion is adaptable to limit pivotal movement of said panel attachment plate at different positions by being cut to different sizes during the manufacturing of said automobile hinge.

8. The automobile hinge of claim 6, wherein said at least one panel stop member comprises a pair of panel stop members extending from respective ones of said sidewalls of said intermediate member.

9. The automobile hinge of claim 8, wherein said stop members are adaptable to limit pivotal movement of said panel attachment plate at different positions by being cut to different sizes during the manufacturing of said automobile hinge.

10. The automobile binge of claim 1, wherein said center flange of said intermediate member includes a fastener portion extending generally toward said body attachment plate when said intermediate member is in said first position, said intermediate member being securable to said body attachment plate via a fastener at said fastener receiving portion.

11. An automobile hinge for pivotably mounting a pivotable panel component to a vehicle body, said automobile hinge comprising:

a panel attachment plate adapted to be secured to a pivotable panel of a vehicle;

a body attachment plate adapted to be secured to a vehicle body, said body attachment plate comprising a generally planar plate portion and a pair of raised flanges along an edge region of said plate portion, said body attachment plate having a hinge portion, said hinge portion comprising a pair of opposed flanges extending generally transverse to said raised flanges, said raised flanges and said opposed flanges extending generally vertically when said plate portion is generally horizontal; and an intermediate member pivotably attached to said body attachment plate via a pivot member extending through said hinge portion and said intermediate member, said intermediate member comprising a stamped metallic member, said panel attachment plate pivotably attached to said intermediate member, said intermediate member including at least one stop adapted to limit the range of pivotal movement of said panel attachment plate with respect to said intermediate member, said at least one stop limiting the pivotal movement of said panel attachment plate at different positions by being cut to different sizes during the manufacturing of said automobile hinge.

12. The automobile hinge of claim 11, wherein said intermediate member comprises a first portion and a second portion arranged at an angle relative to one another, said intermediate member being pivotably attached to said body attachment plate at a junction of said first and second portions.

13. The automobile hinge of claim 12, wherein said panel attachment plate is pivotably attached to said intermediate member at an end of said second portion opposite said junction of said first and second portions.

14. The automobile hinge of claim 12, wherein said intermediate member includes opposite sidewalls and a center flange extending between said opposite sidewalls.

15. The automobile hinge of claim 14, wherein said at least one panel stop member comprises a pair of panel stop members extending from respective ones of said sidewalls of said intermediate member at said end of said second portion.

16. The automobile hinge of claim 14, wherein said sidewalls of said first portion engage said body attachment plate with said center flange being spaced from said body attachment plate when said intermediate member is pivoted toward a first position where said first portion of said intermediate member is positioned generally along said body attachment plate.

17. The automobile hinge of claim 16, wherein said center flange of said first portion includes a fastener portion extending toward said body attachment plate when said intermediate member is in said first position, said intermediate member being securable to said body attachment plate via a fastener at said fastener receiving portion.

18. The automobile hinge of claim 16, wherein said intermediate member includes a body plate stop member that is configured to engage a portion of said opposed flanges of said body attachment plate to limit pivotal movement of said intermediate member away from said first position.

19. The automobile hinge of claim 18, wherein said body plate stop member comprises at least one flange protruding outwardly from said first portion of said intermediate member and in a direction that is generally transverse to a longitudinal axis of said first portion.

20. A method for making an automobile hinge comprising:

providing a panel attachment plate adapted to be secured to a pivotable panel component of a vehicle;

providing a body attachment plate adapted to be secured to a vehicle body, wherein providing a body attachment plate comprises stamping a body attachment plate out of sheet metal, said body attachment plate being stamped to have a generally planar plate portion and a pair of flanges extending along an edge portion of said plate portion, each of said flanges comprising a first portion extending generally along said edge portion and a second portion extending generally transverse to said first portion, said second portions comprising spaced apart and opposed flanges and defining a hinge portion;

providing an intermediate member by stamping a metallic sheet, said stamped intermediate member comprising first and second leg portions extending from a junction of said first and second leg portions and extending at an angle to one another, each of said first and second leg portions comprising a generally U-shaped cross section extending substantially an entire length thereof and each of said first and second leg portions having opposite sidewalls and a center flange extending between said opposite sidewalls, said junction of said first and second leg portions having opposite sidewalls and a center flange extending between said opposite sidewalls;

pivotably attaching said intermediate member to said body attachment plate, said intermediate member being pivotably attached to said body attachment plate generally at said sidewall of said junction of said first and second leg portions, said intermediate member being pivotable to a first position, where said first leg portion of said intermediate member is positioned generally along and at least partially engages said body attachment plate, said intermediate portion being pivotably attached to said body attachment plate at said hinge portion;

pivotably attaching said panel attachment plate to said intermediate member, said panel attachment plate being pivotably attached to said sidewall of said intermediate member at or near an end portion of said second leg portion;

forming a stop portion at said intermediate member to define a stop, said stop being configured to limit the range of pivotal movement of one of said panel attachment plate and said body attachment plate with respect to said intermediate member; and securing said first leg portion to said body attachment plate when said intermediate member is in said first position.

21. The method of claim 20, wherein forming said stop portion comprises adjusting a stamping tool to form a desired stop on said intermediate member.

22. The method of claim 20, wherein said hinge is adapted to be attached to a vehicle body and a vehicle gate, said method including attaching a vehicle gate to said panel attachment plate and attaching said body attachment plate to a vehicle body.

23. The method of claim 20, wherein forming said stop portion comprises punching a greater portion from said intermediate member to create a greater range of motion of said panel attachment plate with respect to said intermediate member.

24. The method of claim 20, wherein forming said stop portion comprises punching a reduced portion from said intermediate member to create a reduced range of motion of said panel attachment plate with respect to said intermediate member.

25. An automobile hinge for pivotably mounting a pivotable panel component to a vehicle body, said automobile hinge comprising:

a panel attachment plate adapted to be secured to a pivotable panel of a vehicle;

an intermediate member, said intermediate member comprising first and second leg portions angularly disposed relative to one another, said panel attachment plate being pivotably attached at or near an end of said first leg portion opposite a junction of said first and second leg portions; and a body attachment plate, said body attachment plate including a plate portion adapted to be secured to a vehicle body and a pair of raised flanges each having a first flange potion and a second flange portion, said first flange portion extending generally transversely from said plate portion and at least partially along an edge portion of said plate portion, said second flange portion extending generally transversely from said plate portion and at an angle to said first flange portion, said second flange portions being spaced apart and opposing one another and cooperating to define a hinge portion of said body attachment plate, said raised flanges providing structural support to said plate portion, said intermediate member being pivotably attached to said body attachment plate at said hinge portion via a pivot member extending through said second flange portions and through said intermediate member.

26. The hinge of claim 25, wherein said second leg portion of said intermediate member includes at least one stop extending outwardly therefrom and in a direction generally transverse to a longitudinal axis of said second leg portion, said at least one stop of said second leg portion engaging a portion of at least one of said second flange portions of said body attachment plate to limit pivotal movement of said intermediate member about said pivot member.

27. The hinge of claim 25, wherein said first and second leg portions of said intermediate member comprise opposite sidewalls and a center flange extending between said opposite sidewalls.

28. The hinge of claim 27, wherein said sidewalls of said second leg portion engage said plate portion of said body attachment plate with said center flange being spaced from said plate portion when said intermediate member is pivoted toward a first position where said second leg portion is positioned generally along said plate portion.

29. The hinge of claim 28, wherein said intermediate member is securable in said first position relative to said body attachment plate.

30. The hinge of claim 29, wherein said center flange of said second leg portion includes a fastener portion extending generally toward said plate portion when said intermediate member is in said first position, said intermediate member being securable to said plate portion via a fastener at said fastener receiving portion.

31. The hinge of claim 25, wherein said first leg portion of said intermediate member includes at least one stop adapted to limit the range of pivotal movement of said panel attachment plate with respect to said intermediate member.

32. The hinge of claim 31, wherein said at least one stop is adapted to limit the pivotal movement of said panel attachment plate at different positions by being cut to different sizes during the manufacturing of said automobile hinge.

33. The method of claim 20, wherein said stop and said intermediate member are stamped to have a selected one of at least two forms of said intermediate member to define the desired stopping position of said one of said panel attachment plate and said body attachment plate with respect to said intermediate member at a respective one of at least two orientations.

34. The method of claim 20, wherein securing said first leg portion to said body attachment plate comprises securing said center flange of said first leg portion to said body attachment plate via a fastener.

* * * * *